US007410322B1

(12) United States Patent
Wallace

(10) Patent No.: US 7,410,322 B1
(45) Date of Patent: Aug. 12, 2008

(54) VIBRATING COMPACTOR APPARATUS

(76) Inventor: Marvin A. Wallace, P.O. Box 932, Wynne, AR (US) 72396

( * ) Notice: Subject to any disclaimer, the term of this patent is extended or adjusted under 35 U.S.C. 154(b) by 0 days.

(21) Appl. No.: 11/709,536

(22) Filed: Feb. 22, 2007

(51) Int. Cl.
*E01C 19/26* (2006.01)

(52) U.S. Cl. ..... 404/117; 404/128

(58) Field of Classification Search ..... 404/117, 404/122, 128; 37/142.5; 403/120
See application file for complete search history.

(56) References Cited

U.S. PATENT DOCUMENTS 5,526,590 A * 6/1996 Palm et al. ..... 37/142.5
6,244,355 B1 * 6/2001 Hall ..... 172/40
6,318,006 B1 * 11/2001 Hall ..... 37/367

* cited by examiner

*Primary Examiner*—Gary S Hartmann
(74) *Attorney, Agent, or Firm*—Dunlap, Codding & Rogers, P.C.

(57) ABSTRACT

A vibrating trench compactor apparatus including a first frame, a second frame, and a compactor wheel. The first frame has an adapter plate connectable to a vehicle and a first arm and second arm extending from the adapter plate. A plurality of vibration dampening members are disposed through each arm. The second frame has a motor mounting plate and a first leg and a second leg extending from the motor mounting plate where the first and second leg are interconnected to the vibration dampening members. The compactor wheel is rotatably connected to the first leg and the second leg and a vibration motor is mounted to the motor mounting plate of the second frame for imparting vibrational movement to the compactor wheel via the second frame.

9 Claims, 3 Drawing Sheets

VIBRATING COMPACTOR APPARATUS

BACKGROUND OF THE INVENTION

1. Field of the Invention

The present invention relates generally to devices for compacting materials, such as soil, and more particularly, but not by way of limitation, to a vibrating trench compacting apparatus.

2. Brief Description of Related Art

In the prior art there have been various trench compaction devices using vibratory wheels for compacting material into trenches. These trench compacting devices have also even been equipped with isolation mounts and mounted onto vehicles, such as skid steers.

The previous trench compaction devices have come equipped with a frame that mounts to the skid steer loader and another frame having a vibration transmitting means mounted thereon and a wheel connected thereto. The compacting devices also have a vibration dampening system separating the frame mounted to the skid steer loader and the frame having the vibration transmitting means mounted thereon. The previous dampening systems are provided with a plurality of dampening members. The dampening members are mounted between the two frames whereby an excessive amount of shear force is applied to the dampening members causing them to breakdown and wear out rather quickly.

DETAILED DESCRIPTION OF EXEMPLARY EMBODIMENTS

Figure 1:
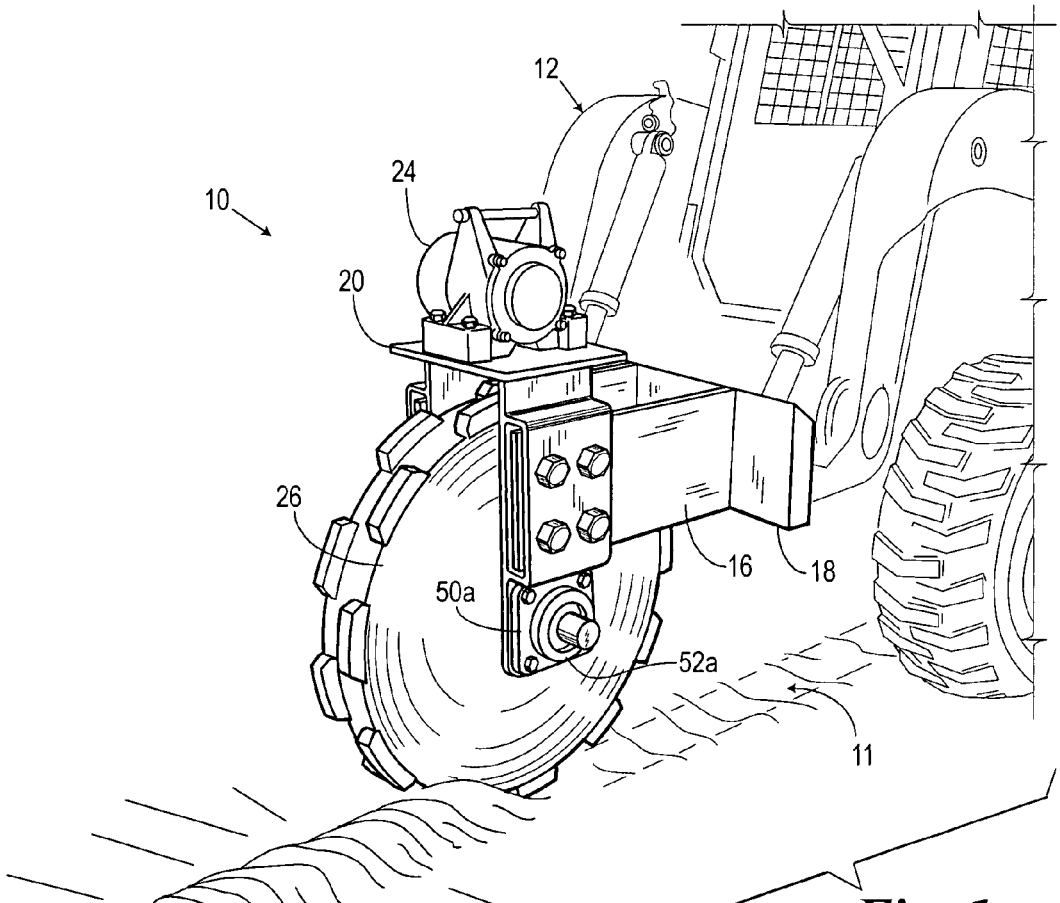
FIG. 1 is a perspective view of a vibrating compactor apparatus, constructed in accordance with the present invention, shown attached to the front of a skid steer and compacting soil in a trench.

Referring to the drawings, and more particularly to FIG. 1, a vibrating compactor apparatus 10 constructed in accordance with the present invention is shown compacting dirt in a trench 11. The apparatus 10 is adapted to be mounted to a vehicle 12, such as a skid steer, a skid steer loader, a skid loader, a self-propelled loader, a tractor, or the like. The vehicle 12 is equipped with a mounting plate (not shown), commonly known as a quick attach plate. The mounting plate can be pivotably attached to the vehicle 12.

In general, the apparatus 10 includes a first frame 16, a second frame 20 attached to the first frame 16, a vibration motor 24 connected to the second frame 20, and a compactor wheel 26 rotatably connected to the second frame 20. The vibration motor 24 is mounted to the second frame 20 to vibrate the second frame 20, and thus vibrate the compactor wheel 26. The vibration imparted to the second frame 20 is isolated from the first frame 16, and thus the vehicle 12 in a manner to be described in detail below.

Figure 2:
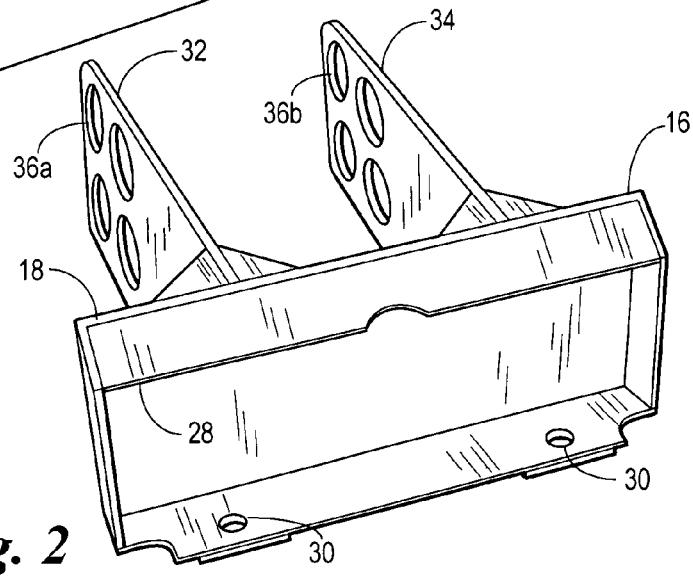
FIG. 2 is a perspective view of a first frame of the vibrating compactor apparatus.

As shown in FIG. 2, the first frame 16 has an adapter plate 18 for mounting the first frame 16 to the mounting plate of the vehicle 12. The adapter plate 18 is provided with a lip 28 creating a cavity for accepting the mounting plate of the vehicle 12 and a plurality of adapter plate holes 30 for allowing the first frame 16 to be securely mounted to the mounting plate. The first frame 16 can be securely mounted to the mounting plate via the adapter plate holes 30 in any suitable manner known in the art, such as with nuts and bolts, bolts and cotter pins, or the like. The first frame 16 further includes a first arm 32 and a second arm 34 extending from the adapter plate 18 in a spaced apart, parallel relationship. The first arm 32 and the second arm 34 are each provided with a plurality of sleeve receiving holes 36*a* and 36*b*, respectively, near the distal end of the first arm 32 and the second arm 34.

Figure 3:
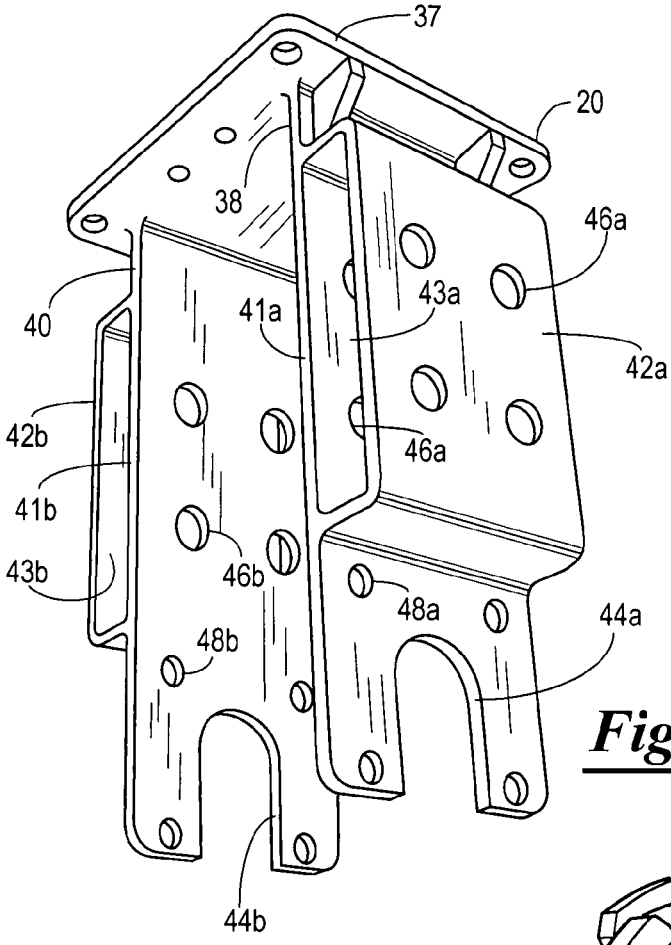
FIG. 3 is a perspective view of a second frame of the vibrating compactor apparatus.

Referring now to FIG. 3, the second frame 20 includes a motor mounting plate 37, a first leg 38, and a second leg 40. The first and second legs 38 and 40 extend from the motor mounting plate 37 in a generally spaced apart, parallel relationship. As shown, the first leg 38 includes an inner plate 41*a* and an outer plate 42*a* creating a slot 43*a* for receiving the first arm 32 of the first frame 16. The outer plate 42*a* is shown to be substantially channel shaped. It will be appreciated, however, that the configuration of the outer plate 42*a* may be varied. For example, the outer plate may be shaped substantially identical to the inner plate and spaced from the inner plate to create a slot. Also, in certain embodiments the outer plate 42*a* may be omitted.

The inner plate 41*a* and outer plate 42*a* have a plurality of connector receiving holes 46*a*, which are adapted to be aligned with the sleeve receiving holes 36*a* of the first arm 32 of the first frame 16. The outer plate 42*a* is provided with a stop member 47*a* positioned above each connector receiving hole 46*a*. The first leg 38 further includes an opening 44*a* in communication with the distal end of the first leg 38 and a plurality of bearing mount holes 48*a*.

The second leg 40 includes an inner plate 41*b* and an outer plate 42*b* creating a slot 43*b* for receiving the second arm 34 of the first frame 16. The outer plate 42*b* is shown to be substantially channel shaped. It will be appreciated, however, that the configuration of the outer plate 42*b* may be varied. For example, the outer plate 42*b* may be shaped substantially identical to the inner plate 41*b* and spaced from the inner plate to create a slot. Also, in certain embodiments the outer plate 42*b* may be omitted.

The inner plate 41*b* and outer plate 42*b* have a plurality of connector receiving holes 46*b*, which are adapted to be aligned with the sleeve receiving holes 36*b* of the second arm 34 of the first frame 16. Like the outer plate 42*a*, the outer plate 42*b* is provided with a stop member (not shown) positioned above each connector receiving hole 46*b*. The second leg 40 further includes an opening 44*b* in communication with the distal end of the second leg 40 and a plurality of bearing mount holes 48*b*.

Figure 4:
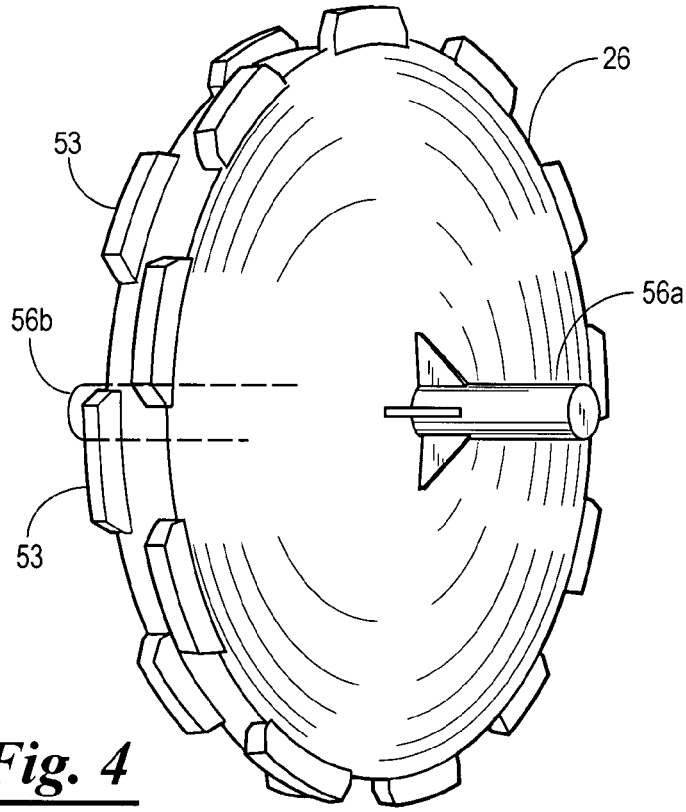
FIG. 4 is perspective view of a compactor wheel of the vibrating compactor apparatus.

As shown in FIG. 4, the compactor wheel 26 is a solid, circular member having a width sized to be received in a trench, such as the trench 11. It will be appreciated that the compactor wheel 26 may be constructed in a variety of widths and may also be formed partly solid or spooked. The outer perimeter of the compactor wheel 26 is provided with a plurality of teeth 53 to facilitate compaction. The size, shape, and spacing of the teeth 53 may be varied, or the teeth 53 may be omitted.

To permit rotation, the compactor wheel 26 has an axle defined by axle rods 56*a* and 56*b*.

As shown in FIGS. 1, 3, and 4, the compactor wheel 26 is secured to the second frame 20 by inserting the axle rod 56*a* into a bearing 52*a* which is housed in a bearing plate 50*a*. The bearing plate 50*a* is mounted to the first leg 38 of the second frame 20 via the bearing mount holes 48*a*, thus allowing for the axle rod 56*a* to be received by the opening 44*a* in communication with the distal end of the first leg 38. The bearing plate 50*a* can be mounted in any suitable manner, such as bolted, screwed, pinned, or the like. The bearing 52*a* allows the axle rod 56*a* and thus the compactor wheel 26 to rotate as the apparatus 10 is put into use. It should be appreciated that, while not shown, a second bearing plate and bearing would be used with respect to the axle rod 56*b*, the opening 44*b*, the bearing mount holes 48*b*, and the second leg 40 in a similar manner to how the bearing plate 50*a* and bearing 52*a* were described with respect to the axle rod 56*a*, the opening 44*a*, the bearing mount holes 48*a*, and the first leg 38.

Figure 5:
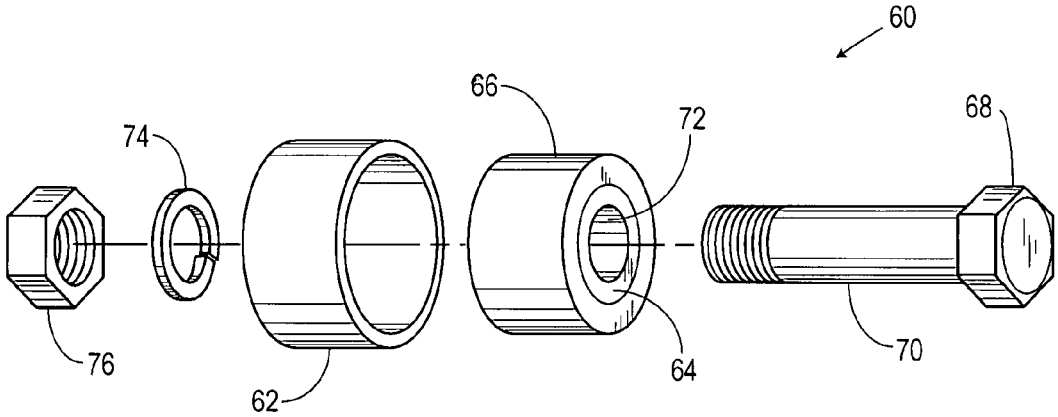
FIG. 5 is an exploded, perspective view of a vibration dampening assembly of the vibrating compactor apparatus.
Figure 6:
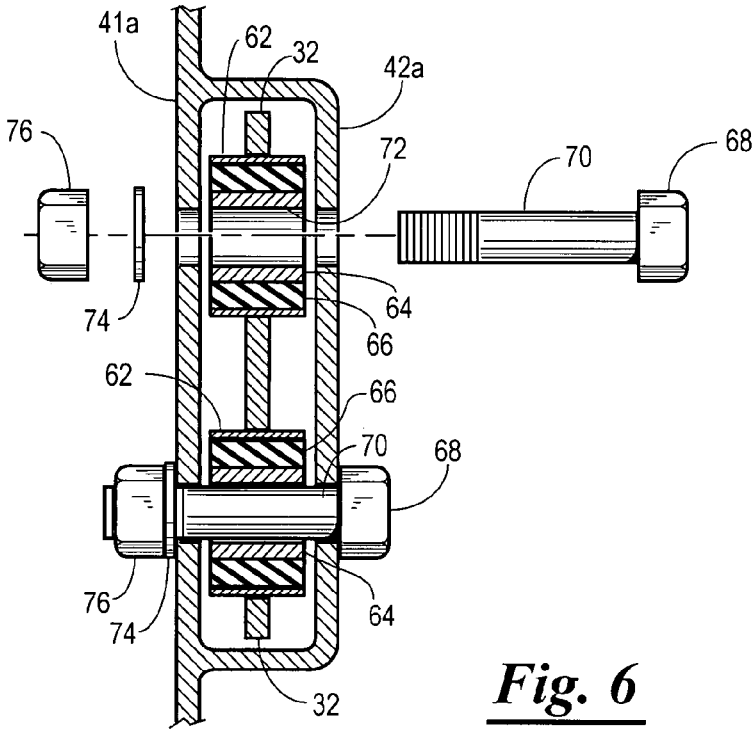
FIG. 6 is a partially exploded, cross-sectional view of the vibration dampening assembly, a portion of the first frame, and a portion of the second frame.

Referring now to FIGS. 1, 5, and 6, the first and second arms 32 and 34 of the first frame 16 are connected to the second frame 20 with a plurality of vibration dampening assemblies 60 to substantially isolate the vibration imparted to the second frame 20 by the vibration motor 24 from the first frame 16. The first and second arms 32 and 34 of the first frame 16 are connected to the second frame 20 in an identical manner. Thus, only the manner of connecting the first arm 32 of the first frame 16 to the second frame 20 will be described in detail with reference to FIGS. 1, 5, and 6.

In a preferred embodiment, each of the vibration dampening assemblies 60 includes an outer rigid sleeve 62, an inner rigid sleeve 64, and a vibration dampening member 66 interposed between the outer rigid sleeve 62 and the inner rigid sleeve 64. As shown in FIG. 6, the outer rigid sleeves 62 are disposed through the sleeve receiving holes 36*a* of the first arm 32 and connected to the first arm 32 at a medial portion of the outer rigid sleeve 62 so that the first arm 32 generally straddles the outer rigid sleeves 62. The outer rigid sleeves 62 may be secured to the first frame 16 in any suitable manner, such as welding. The vibration dampening member 66 and the inner rigid sleeve 64 are positioned in the outer rigid sleeve 62.

The outer rigid sleeve 62, the vibration dampening member 66, and the inner rigid sleeve 64 have a length greater than the width of the first arm 32 of the first frame 16 such that ends of the outer rigid sleeve 62, the vibration dampening member 66, and the inner rigid sleeve 64 extend away from the first arm 32. It should be appreciated by those of ordinary skill in the art, however, that the length of the outer rigid sleeve 62, the vibration dampening member 66, and the inner rigid sleeve 64, as well as the width of the first arm 32 of the first frame 16, may be varied. The vibration dampening member 66 may be fabricated of any durable elastomeric, vibration dampening material.

To connect the first frame 16 to the second frame 20, the first arm 32 together with the outer rigid sleeve 62, the vibration dampening member 66, and the inner rigid sleeve 64 is inserted into the slot 43*a* of the first leg 38 of the second frame 20. Simultaneously, the second arm 34 together with the outer rigid sleeve 62, the vibration dampening member 66, and the inner rigid sleeve 64 is inserted into the slot 43*b* of the second leg 40. The second frame 20 is secured to the first frame 16 with a plurality of connector members 68.

As shown in FIGS. 5 and 6, the connector members 68 are pins which include a head 69 and a shaft 70. The head 69 has a generally circular shape with a flat edge 69*a* for engaging the stop member 47*a* to prevent rotation of the connector members 68. The shaft 70 is provided with an opening 72 on the distal end of the shaft 70 that is preferably oriented in a substantially parallel relationship to the flat edge 69*a*. The connector members 68 are inserted through the opening 74 of the inner rigid sleeve 64 and the connector receiving holes 46*a* of the outer plate 42*a* and the inner plate 41*a* until the flat edge 69*a* of the head 69 engages the bottom of the stop members 47. To reduce wear, the inner plate 41*a* and the outer plate 42 are provided with support bushings 76 positioned within the connector receiving holes 46*a*. The connector members 68 are secured to the second frame 20 by inserting a securing bolt 80 through the opening 72 and securing the bolt 80 in place with a nut 82. The parallel relationship of the opening 72 with respect to the flat edge 69*a* of the head 69 causes the opening 72 to be generally horizontally disposed allowing for more efficient assembly and disassembly. Also, a spacer 78 is provided between the inner plate 41*a* and the opening 72 to further facilitate assembly and disassembly.

In use, the first frame 16 is secured to the mounting plate (not shown) of the vehicle 12 which is provided with mechanisms for positioning the vibrating compactor apparatus 10 in a trench, such as the trench 11. The vehicle 12 may be moved in a forward or rearward direction with the vibration motor 24 energized to cause the second frame 20, and thus the compacting wheel 26 to vibrate. The vibration imparted to the second frame 20 is transferred to the inner rigid sleeves 64 by the shafts 70 of the connector members 68. The vibration dampening members 66, in turn, absorb and significantly isolate the vibration imparted to the second frame 20 from the first frame 16 and the vehicle 12. With the vibration dampening members 66 being interposed between the outer rigid sleeve 62 and the inner rigid sleeve 64, the vibration dampening members 66 are subjected primarily to compression forces.

Changes may be made in the combination and arrangement of parts or elements as here to fore set forth in the specification and shown in the drawing without departing from the spirit and scope of the invention as defined in the following claims.

What is claimed is:

1. A vibrating compactor apparatus, comprising:

a first frame having an adapter plate connectable to a vehicle, a first arm extending from the adapter plate, and a second arm extending from the adapter plate in a spaced apart relationship with the first arm;

a first vibration dampening member disposed through the first arm of the first frame;

a second vibration dampening member disposed through the second arm of the first frame;

a second frame having a motor mounting plate, a first leg extending from the motor mounting plate, and a second leg extending from the motor mounting plate in a spaced apart relationship with the first leg, the first leg interconnected to the first vibration dampening member and the second leg interconnected to the second vibration dampening member;

a compactor wheel rotatably connected to the first leg and the second leg of the second frame; and a vibration motor mounted to the motor mounting plate of the second frame for imparting vibrational movement to the compactor wheel via the second frame, wherein the first vibration dampening member is interposed between a first outer rigid sleeve and a first inner rigid sleeve, the first outer rigid sleeve being connected to the first arm of the first frame, and wherein the second vibration dampening member is interposed between a second outer rigid sleeve and a second inner rigid sleeve, the second outer rigid sleeve being connected to the second arm of the first frame.

2. The compactor apparatus of claim 1, further comprising a first shaft extending through the first leg and the first inner rigid sleeve and a second shaft extending through the second leg and the second rigid inner sleeve.

3. The compactor apparatus of claim 2, wherein the first outer sleeve is connected to the first arm at a medial portion of the first rigid outer sleeve, and wherein the second outer sleeve is connected to the second arm at a medial portion of the second rigid outer sleeve.

4. The compactor apparatus of claim 1, further comprising a plurality of vibration dampening members disposed through the first arm of the first frame and a plurality of vibration dampening members disposed through the second arm of the first frame.

5. A vibrating compactor apparatus, comprising:

a first frame having an adapter plate connectable to a vehicle, a first arm extending from the adapter plate, and a second arm extending from the adapter plate in a spaced apart relationship with the first arm;

a first vibration dampening member disposed through the first arm of the first frame;

a second vibration dampening member disposed through the second arm of the first frame;

a second frame having a motor mounting plate, a first leg extending from the motor mounting plate, and a second leg extending from the motor mounting plate in a spaced apart relationship with the first leg, each of the first leg and the second having a slot, the first arm and the first vibration dampening member positioned in the slot of the first leg and the second leg and the second vibration dampening member positioned in the slot of the second leg, the first leg interconnected to the first vibration dampening member and the second leg interconnected to the second vibration dampening member;

a compactor wheel rotatably connected to the first leg and the second leg of the second frame; and a vibration motor mounted to the motor mounting plate of the second frame for imparting vibrational movement to the compactor wheel via the second frame.

6. The compactor apparatus of claim 5, wherein the first vibration dampening member is interposed between a first outer rigid sleeve and a first inner rigid sleeve, the first outer rigid sleeve being connected to the first arm of the first frame, and wherein the second vibration dampening member is interposed between a second outer rigid sleeve and a second inner rigid sleeve, the second outer rigid sleeve being connected to the second arm of the first frame.

7. The compactor apparatus of claim 6, wherein the slots of the first leg and the second leg are defined by an outer plate and an inner plate, and wherein the compactor device comprises a first shaft extending through the first inner rigid sleeve and the outer and inner plates of the first leg, and a second shaft extending through the second rigid inner sleeve and the outer and inner plates of the second leg.

8. The compactor apparatus of claim 7, wherein the first outer sleeve is connected to the first arm at a medial portion of the first rigid outer sleeve, and wherein the second outer sleeve is connected to the second arm at a medial portion of the second rigid outer sleeve.

9. The compactor apparatus of claim 5, further comprising a plurality of vibration dampening members disposed through the first arm of the first frame and a plurality of vibration dampening members disposed through the second arm of the first frame.

* * * * *